US005806929A

United States Patent [19]

Choi

[11] Patent Number: 5,806,929

[45] Date of Patent: Sep. 15, 1998

[54] CHAIR FOR KEEPING A STRAIGHT POSTURE

[76] Inventor: Kyung Deok Choi, 597-1, Yongu-Ri, Cholma-Myon, Kijang-Gun, Pusan, Rep. of Korea

[21] Appl. No.: 778,622

[22] Filed: Jan. 3, 1997

[30] Foreign Application Priority Data

Jan. 3, 1996 [KR] Rep. of Korea ..... 1996-232

[51] Int. Cl.[6] ..... A47C 1/00

[52] U.S. Cl. ..... 297/284.9; 297/116; 297/411.37; 297/466

[58] Field of Search ..... 297/466, 423.17, 297/116, 115, 411.31, 411.37, 411.38, 284.9, 284.11

[56] References Cited

U.S. PATENT DOCUMENTS 5,181,288 1/1993 Heaton et al. ..... 5/609 X
5,407,248 4/1995 Jay et al. ..... 297/284.9 X
5,613,252 3/1997 Yu et al. ..... 5/609 X
5,636,900 6/1997 Wilkie et al. ..... 297/284.9 X

FOREIGN PATENT DOCUMENTS 2556587 6/1985 France ..... 297/464
793883 4/1958 United Kingdom ..... 297/115

*Primary Examiner*—Peter M. Cuomo
*Assistant Examiner*—David E. Allred
*Attorney, Agent, or Firm*—Birch, Stewart, Kolasch & Birch, LLP

[57] ABSTRACT

The chair of the present invention includes a pair of squeezing members operatively attached to the pair of arm rests whereby when the user sits on the chair, the thighs and the pelvis of the user can be smoothly squeezed by operating the pair of squeezing members for keeping a straight posture of the user.

5 Claims, 2 Drawing Sheets

CHAIR FOR KEEPING A STRAIGHT POSTURE

BACKGROUND OF THE INVENTION

1. Field of the Invention

The present invention relates to a chair for keeping straight posture and more particularly, an improved chair for correcting and straightening a user's figure in a sitting posture by attaching a pair of movable squeezing members to both arm rests of the chair and adjusting the pair of movable squeezing members to both thighs of the user.

2. Description of Related Art

Various types of chairs for keeping a straight posture are known in the art. Generally, a chair provides a large space for the user to sit fully therein. Therefore, when the user such as a worker, or a student preparing himself for an examination, sits for a long time, the weight of the upper part of the human body loads on the thigh and pelvis, so that the posture of the user falls into disorder. Accordingly, the user who sits on the conventional chair for a long time is susceptible to backbone change or lumbago. Also, the user cannot increase production efficiency.

SUMMARY OF THE INVENTION

Therefore, it is an object of the present invention to provide a chair for keeping straight posture, which eliminates the above problems encountered with the conventional chair.

Another object of the present invention is to provide an improved chair for correcting and straightening user's figure in a sitting posture by attaching a pair of movable squeezing members to both arm rests of the chair and adjusting to both pair of movable squeezing members to both thighs of the user.

A further object of the present invention is to provide an improved chair for adjusting a pair of movable squeezing members by screwing a pair of handles.

Still another object of the present invention is to provide a chair for correcting posture of the user, which is simple in structure, inexpensive to manufacture, durable in use, and refined in appearance.

Other objects and further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Briefly described, the present invention is directed to a chair for keeping a straight posture, which includes a pair of squeezing members operatively attached to the pair of arm rests whereby when the user sits on the chair, the thighs and the pelvis of the user can be smoothly squeezed by operating the pair of squeezing members for keeping a straight posture of the user.

BRIEF DESCRIPTION OF THE DRAWINGS

The present invention will become more fully understood from the detailed description given hereinbelow and the accompanying drawings which are given by way of illustration only, and thus, are not limitative of the present invention, and wherein.

DETAILED DESCRIPTION OF THE PREFERRED EMBODIMENTS

Figure 1:
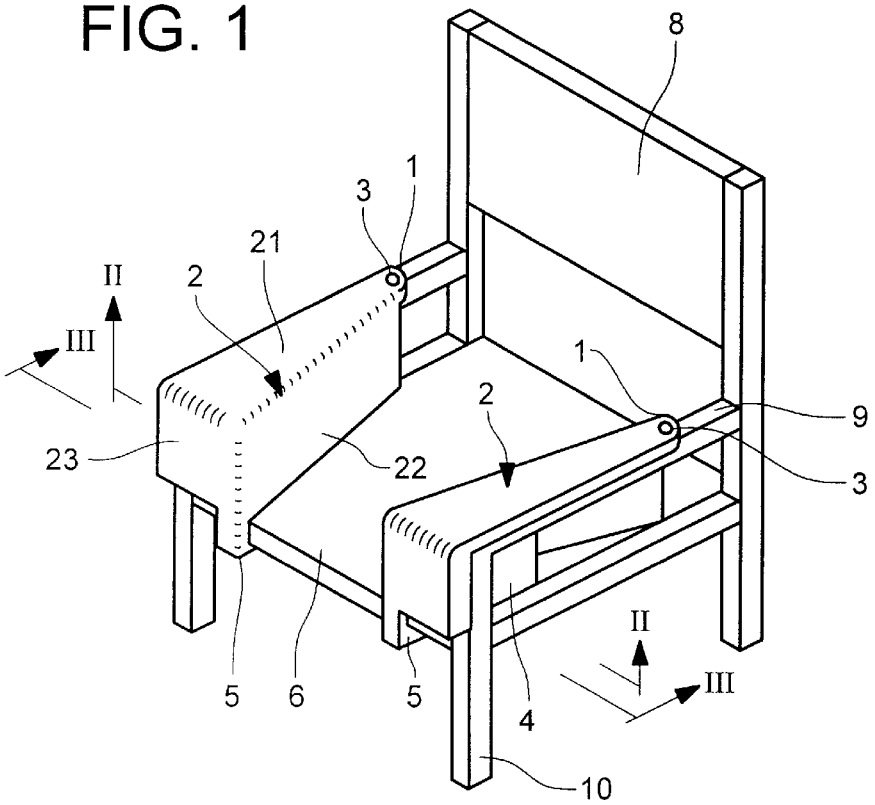
FIG. 1 is a perspective view of a chair for keeping a straight posture of the present invention.
Figure 2:
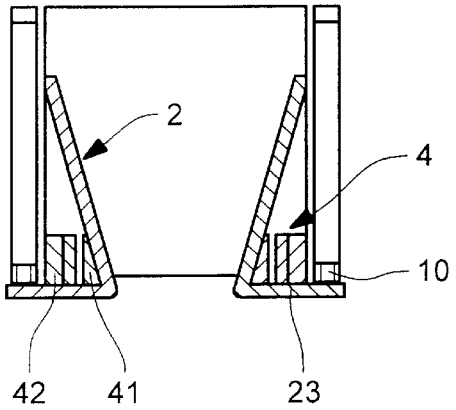
FIG. 2 is a cross-sectional view of FIG. 1, taken along line III—III.
Figure 3:
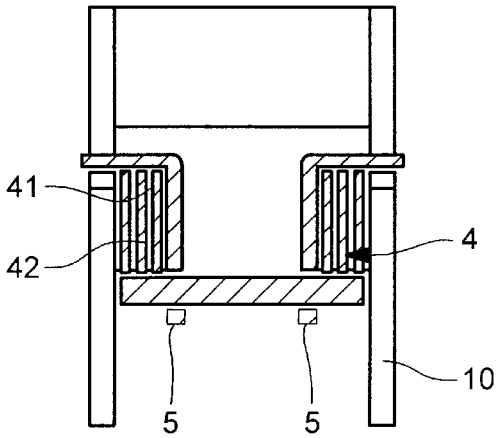
FIG. 3 a sectional view of FIG. 1, taken along line II—II.

Referring now in detail to the drawings for the purpose of illustrating preferred embodiments of the present invention, the chair for keeping a straight posture as shown in FIGS. 1, 2, and 3, includes a seating base 6, four legs 10, a back 8, a pair of arm rests 9, and a pair of movable squeezing members 2 movably attached to each arm rest 9. A fixed pin 1 is supported on each arm rest 9.

Each squeezing member 6 has a pentahedron configuration wherein the pentahedron has a triangular top surface 21, a rectangular inside surface 22, and a regular square front side surface 23. A pivotal aperture 3 is disposed on a conical area of the triangular top surface 21 for pivotally receiving the fixed pin 1 on the arm rest 9 of the chair. Each regular square front side surface 23 is provided with an L-shaped clip 5 for preventing separation from the chair.

Figure 4:
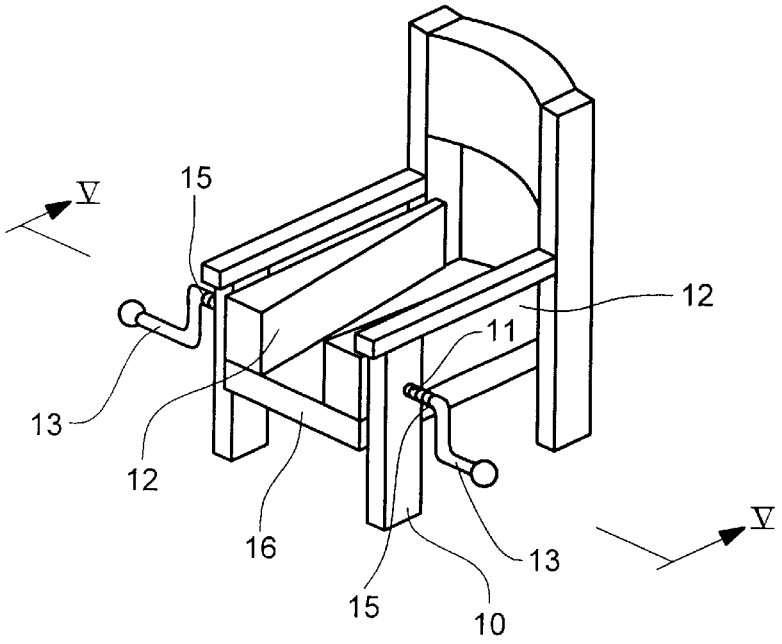
FIG. 4 is a perspective view of another embodiment of the chair for keeping a straight posture of the present invention.

As shown in FIGS. 3 and 4, each squeezing member 6 contains a plurality of pentahedron wedges 41 and several hexahedron wedges 42. The number of hexahedrons 42 employed is two or three. Therefore, when the user sits on the seating base 6 of the chair, the distance of both squeezing members 2 is a little smaller than the size of the pelvis of the user by adjusting the number of the wedges 4. That is, the distance between both squeezing members 2 can be reduced by adding wedges 42.

Figure 5:
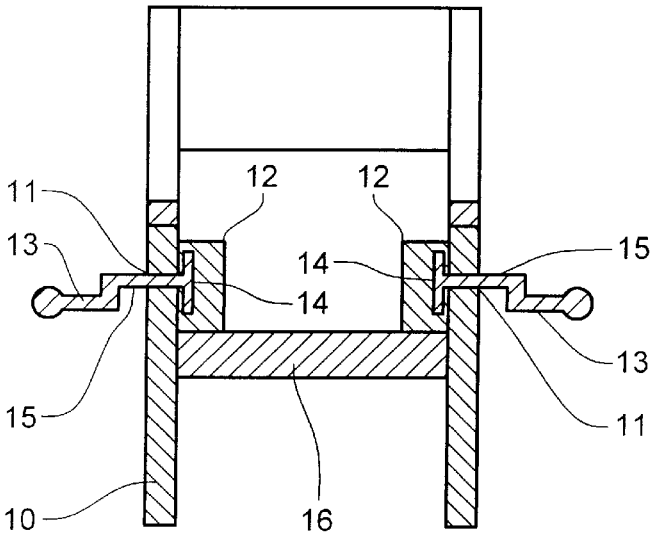
FIG. 5 is a sectional view of FIG. 3, taken along line V—V

As shown in FIGS. 4 and 5, there are additional embodiments of the chair for keeping a straight posture according to the present invention. The chair according to the present invention includes a seating base 16 and four legs 10. Two front legs 10 are provided with a screwed aperture 11 disposed on the upper portion thereof, respectively. The chair according to the present invention further includes a pair of handles 13 having a screwed shaft 15 for matching with the screwed aperture 11, and a pair of squeezing members 12 which secure to both ends of the screwed shafts 15 of the handles 13. Each squeezing member 12 (FIG. 4) has a pentahedron configuration wherein the top surface of the pentahedron is a triangle.

Therefore, when the user sits on the seating base 16 of the chair as shown in FIG. 4, the distance of both squeezing members 12 is little smaller than the size of the pelvis of the user by screwing into the inside direction. That is, the distance of both squeezing members 12 can reduce by rotating the handles 13 at the same speed.

Accordingly, the chair for keeping a straight posture according to the present invention can effectively prevent from loosening the figure of the user in a sitting posture. Because, generally, when the user sits on the conventional chair, the weight of the upper body expands to the both thighs and the pelvis of the user. Therefore, the thigh bone and the pelvis bone can easily expand, so that the backbone can readily change to an undesirable serpentine configuration.

However,in the chair having the pair of squeezing members 2 and 12 according to the present invention, the pair of squeezing members 2 and 12 can effectively prevent the thighs from being wide open by clamping the thighs closely to each other, so that the backbone of the user is prevented from transforming. Additionally, the chair of the present invention can treat or reduce any pain of the backbone.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A chair for keeping a straight posture, comprising:

a seating base, four legs, a back and a pair of arm rests, and a pair of squeezing members pivotally attached to said pair of arm rests, about a vertical axis each of said pair of squeezing members having a pentahedron configuration and including:

a top triangular surface having a pivotal aperture disposed therein, a rectangular inside surface, a regular square front side surface having an L-shaped clip extending therefrom and engaging an underside of said seating base for preventing separation from said chair, and a plurality of wedges inserted between said squeezing member and a respective one of said arm rests for pivotally adjusting the distance between each said squeezing members and a respective one of said arm rests, whereby when the user sits on the seating base of the chair, the user can effectively keep a straight posture by squeezing of the thighs and the pelvis by the pair of squeezing members.

2. The chair for keeping a straight posture of claim 1, wherein said pair of arm rests each include a fixed pin for pivotally receiving each said pivotal aperture, respectively.

3. The chair for keeping a straight posture of claim 1, wherein said plurality of wedges contain one pentahedron configured wedge and a plurality of hexahedron configured wedges.

4. The chair for keeping a straight posture of claim 3, wherein the number of said hexahedron configured wedges is two.

5. The chair for keeping a straight posture of claim 3, wherein the number of said hexahedron configured wedges is three.

* * * * *